US010338486B2

(12) United States Patent
Abe et al.

(10) Patent No.: US 10,338,486 B2
(45) Date of Patent: Jul. 2, 2019

(54) ELECTROPHOTOGRAPHIC PHOTOSENSITIVE MEMBER AND ELECTROPHOTOGRAPHIC APPARATUS

(71) Applicant: CANON KABUSHIKI KAISHA, Tokyo (JP)

(72) Inventors: Yukihiro Abe, Kashiwa (JP); Jun Ohira, Moriya (JP); Kazunari Ooyama, Toride (JP); Takanori Ueno, Nagareyama (JP); Hironori Owaki, Kashiwa (JP); Yasuo Kojima, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/120,563

(22) Filed: Sep. 4, 2018

(65) Prior Publication Data

US 2019/0072866 A1 Mar. 7, 2019

(30) Foreign Application Priority Data

Sep. 1, 2017 (JP) ..... 2017-168829

(51) Int. Cl.

| | |
|---|---|
| ***G03G 5/00*** | (2006.01) |
| ***G03G 5/147*** | (2006.01) |
| ***G03G 5/082*** | (2006.01) |
| ***G03G 5/14*** | (2006.01) |
| ***G03G 15/00*** | (2006.01) |

(52) U.S. Cl.

CPC ..... *G03G 5/14704* (2013.01); *G03G 5/082* (2013.01); *G03G 5/08214* (2013.01); *G03G 5/08278* (2013.01); *G03G 5/08285* (2013.01); *G03G 5/144* (2013.01); *G03G 15/75* (2013.01)

(58) Field of Classification Search

CPC ..... G03G 5/14704
USPC ..... 430/66
See application file for complete search history.

(56) References Cited

U.S. PATENT DOCUMENTS

| | | | |
|---|---|---|---|
| 6,576,387 | B2 | 6/2003 | Hashizume et al. |
| 6,636,715 | B2 | 10/2003 | Yamazaki et al. |
| 7,229,730 | B2 | 6/2007 | Ohira et al. |
| 7,229,731 | B2 | 6/2007 | Aoki et al. |
| 7,704,657 | B2 | 4/2010 | Uesugi et al. |
| 7,732,113 | B2 | 6/2010 | Nakamura et al. |
| 7,799,496 | B2 | 9/2010 | Uesugi et al. |
| 2006/0194132 | A1 | 8/2006 | Hosoi et al. |
| 2009/0214967 | A1 | 8/2009 | Iwanaga et al. |

FOREIGN PATENT DOCUMENTS

| | | | |
|---|---|---|---|
| EP | 0241033 | A1 | 10/1987 |
| EP | 1207428 | A2 | 5/2002 |
| JP | S63-223660 | A | 9/1988 |
| JP | 2002-148838 | | 5/2002 |
| WO | 2018/030041 | A1 | 2/2018 |

*Primary Examiner* — Mark A Chapman
(74) *Attorney, Agent, or Firm* — Venable LLP

(57) ABSTRACT

An average value of a hydrogen content ratio of a surface layer made of hydrogenated amorphous carbon is set to be 0.40 or less and a maximum value of an $sp^2$ bonding ratio in an outermost surface region of the surface layer made of the hydrogenated amorphous carbon is set to be 0.50 or less.

10 Claims, 4 Drawing Sheets

ELECTROPHOTOGRAPHIC PHOTOSENSITIVE MEMBER AND ELECTROPHOTOGRAPHIC APPARATUS

BACKGROUND OF THE INVENTION

Field of the Invention

The present invention relates to an electrophotographic photosensitive member used in an electrophotographic apparatus.

Description of the Related Art

As an electrophotographic photosensitive member of an inorganic material, an amorphous silicon electrophotographic photosensitive member in which hydrogenated amorphous silicon is used for a photoconductive layer has been known. It should be noted that the hydrogenated amorphous silicon is also referred to as an "a-Si:H", the electrophotographic photosensitive member is referred to as a "photosensitive member", and the amorphous silicon electrophotographic photosensitive member is referred to as an "a-Si photosensitive member".

Configuration examples of the a-Si photosensitive member may include a configuration in which a lower blocking layer, a photoconductive layer, an upper blocking layer, and a surface layer are sequentially laminated on a conductive substrate. Among them, the a-Si photosensitive member to which a hydrogenated amorphous carbon film is applied as a material of the surface layer has been known. It should be noted that hydrogenated amorphous carbon is also referred to as an "a-C:H". Since the a-C:H surface layer has high hardness and excellent durability, it is expected to be mainly used in an electrophotographic apparatus having a high process speed.

Conventionally, to improve the durability of the electrophotographic photosensitive member using the a-C:H surface layer, a method for increasing hardness of an a-C:H surface layer and improving wear resistance has been used. Japanese Patent Application Laid-Open No. 2002-148838 discloses a technique for improving the durability of the electrophotographic photosensitive member by increasing the hardness of the a-C surface layer.

The electrophotographic photosensitive member is sequentially exposed to a charging step, an exposure step, a developing step, a transferring step, a cleaning step and a destaticization step in an image forming process of the electrophotographic apparatus. The charging step is often performed by atmospheric discharge, and ions generated by the atmospheric discharge reach the surface of the electrophotographic photosensitive member to apply electric charges to the surface of the photosensitive member. Discharge products such as ozone are generated in the atmospheric discharge in addition to the ions. Therefore, the photosensitive member is affected by the ions generated in the charging step and the discharge products. In particular, in an electrophotographic apparatus employing a negative charging process, since negative ions contributing to electrification are ions having strong oxidation power such as nitrate acid ions and carbonic acid ions, the photosensitive member tends to be oxidized as compared to a positive charging process.

In addition, depending on the characteristics of the a-C:H surface layer, the negative ions or the discharge products that have reached the surface layer may permeate through the surface layer and reach a layer under the surface layer. For this reason, there is a case in which the negative ions or the discharge products that reach the layer under the surface layer oxidize the layer under the surface layer to change the characteristics of the photosensitive member. As a result, as the characteristics of the a-C:H surface layer, the ability (hereinafter, referred to as a "barrier property") to prevent the negative ions or the discharge products reaching the a-C:H surface layer from permeating through the layer under the surface layer is required.

In addition, a surface resistance of the photosensitive member having the a-C:H surface layer may be low, and it is difficult to maintain a latent image formed in the exposure step and therefore image resolving power may be reduced.

The barrier property and the image resolving power required for the a-C:H surface layer may have a trade-off relationship, and it is very difficult to achieve both of the barrier property and the image resolving power.

SUMMARY OF THE INVENTION

An electrophotographic photosensitive member sequentially includes a substrate, a photoconductive layer, and a surface layer made of hydrogenated amorphous carbon, wherein an average value of a hydrogen content ratio of the surface layer is 0.40 or less, an outermost surface region of the surface layer has a depth of 5 nm or less, and a maximum value of an $sp^2$ bonding ratio in the outermost surface region is 0.50 or less.

Further features of the present invention will become apparent from the following description of exemplary embodiments with reference to the attached drawings.

DESCRIPTION OF THE EMBODIMENTS

Embodiments of the present invention will be described below.

<Electrophotographic Photosensitive Member According to the Present Invention>

First, a layer configuration of an electrophotographic photosensitive member according to the present invention will be described.

Figure 1A:
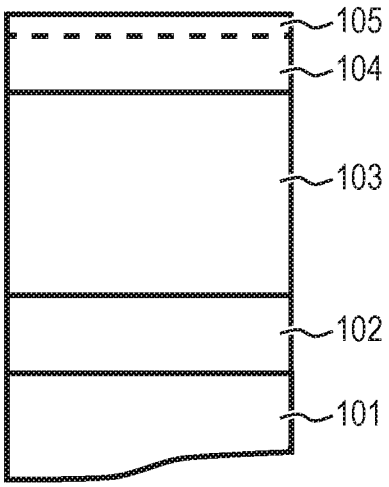
FIG. 1A is a schematic cross-sectional view showing an example of a layer configuration of an electrophotographic photosensitive member according to the present invention.

FIG. 1A is a schematic view showing an example of a layer configuration of an electrophotographic photosensitive member according to the present invention. A lower charge injection blocking layer 102, a photoconductive layer 103, and a surface layer 104 are sequentially laminated on a substrate 101, and an outermost surface region 105 is formed on the surface layer 104. The layer configuration is mainly applied to an a-Si photosensitive member for positive charging.

Figure 1B:
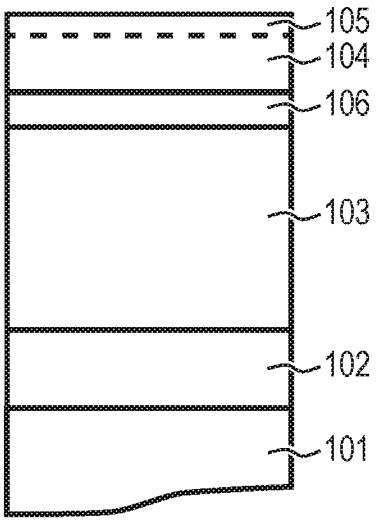
FIG. 1B is a schematic cross-sectional view showing the example of the layer configuration of the electrophotographic photosensitive member according to the present invention.

FIG. 1B is a schematic view showing an example of another layer configuration of the electrophotographic photosensitive member according to the present invention. The lower charge injection blocking layer 102, the photoconductive layer 103, an intermediate layer 106, and the surface layer 104 are sequentially laminated on the substrate 101, and the outermost surface region 105 is formed on the surface layer 104. The intermediate layer 106 included in the layer configuration may have a single layer configuration, a multilayer configuration, or a change layer configuration in which compositions are continuously changed in a film thickness direction.

By making the intermediate layer 106 into the multilayer configuration or the change layer configuration, it is possible to smooth movement of photocarriers between surface layers of different materials and the photoconductive layer. In addition, it is possible to suppress a reflection of image exposure caused by a difference between a refractive index of the surface layer and a refractive index of the photoconductive layer, suppress a light interference caused by a film thickness of the surface layer and suppress a fluctuation in sensitivity of the photosensitive member due to the reduction in the film thickness of the surface layer caused by the long-term use. In addition, unevenness in the sensitivity characteristics of the photosensitive member due to unevenness in the film thickness of the surface layer can be reduced. In addition, it can be applied to the a-Si photosensitive member for negative charging by imparting the charge injection blocking ability to the intermediate layer 106.

Next, each layer and the substrate configuring the electrophotographic photosensitive member having the layer configuration described above will be described.

(Surface Layer)

Hydrogenated amorphous carbon is used as the material of the surface layer. A film thickness of the surface layer is preferably 20 nm or more and 300 nm or less.

A ratio H/(H+C) of the number of atoms of hydrogen atoms (H) to a sum of the number of atoms of hydrogen atoms (H) and the number of atoms of carbon atoms (C) which constitute the surface layer is defined as a hydrogen content ratio. At this time, by setting an average value of the hydrogen content ratio of the hydrogenated amorphous carbon constituting the surface layer to be 0.40 or less, it is possible to obtain the barrier property and prevent the layer under the surface layer from being oxidized.

This is believed to be due to the fact that by reducing the hydrogen content of the surface layer, a bond between the carbon atoms as skeleton atoms is increased, a density of the skeleton atoms is increased, and the barrier property is improved.

When the hydrogenated amorphous carbon is formed by a plasma CVD method, the hydrogen content ratio can be adjusted depending on film formation conditions. Examples of the film forming conditions may include a kind of raw material gases, a flow rate of raw material gas, high frequency power, a reaction pressure, substrate temperature, and the like. As the result of the examination, in order to lower the hydrogen content ratio, decreasing the flow rate of raw material gas, increasing the high frequency power, lowering the reaction pressure, and increasing the substrate temperature each are a method for adjusting preferable conditions. From the viewpoint of improving the barrier property, a method for adjusting any of the film forming conditions is effective, but it was found that increasing the high frequency power and the substrate temperature tends to reduce light transmittance of the surface layer. Therefore, it is preferable to adjust the flow rate of raw material gas and the reaction pressure to be lowered under the low high-frequency power and substrate temperature conditions.

A ratio $sp^2/(sp^2+sp^3)$ of an $sp^2$ bond to a sum of the $sp^2$ bond and an $sp^3$ bond of carbon atoms in the outermost surface region of the surface layer is defined as an $sp^2$ bonding ratio. At this time, since the lower the hydrogen content ratio of the surface layer, the higher the bond between the carbon atoms, the $sp^2$ bonding ratio tends to be increased. Since the higher the $sp^2$ bonding ratio, the closer to characteristics of graphite becomes, the electric resistance is reduced. As the result of the examination, it was found that the surface resistance of the outermost surface region of the surface layer has an effect on image resolving power. That is, by setting the maximum value of the $sp^2$ bonding ratio in the outermost surface region of the surface layer to be 0.50 or less, good image resolving power is obtained.

As the method for forming an outermost surface region of a surface layer, an a-C:H film having the $sp^2$ bonding ratio whose maximum value is set to be 0.50 or less is laminated on an a-C:H layer with improved barrier property to form the outermost surface region. In addition, the a-C:H surface layer with improved barrier property may be subjected to surface treatment to modify the outermost surface region.

Examples of the method for forming an outermost surface region by laminating an a-C:H film having different $sp^2$ bonding ratios may include a method for forming an outermost surface region by laminating an a-C:H film in which a hydrogen content ratio is changed. As the result of the examination, in order to increase the hydrogen content ratio, increasing the flow rate of raw material gas, lowering the high frequency power, increasing the reaction pressure, and lowering the substrate temperature each are a method for adjusting preferable conditions.

If the hydrogen content ratio in the a-C:H film is increased, the bond between the carbon atoms is reduced, such that the $sp^2$ bonding ratio also tends to be decreased. As the result of the examination, when the maximum value of the $sp^2$ bonding ratio in the outermost surface region of the surface layer is set to be 0.50 or less and then the maximum value of the hydrogen content ratio is set to be 0.45 or more, even better image resolving power can be obtained.

Next, examples of the method for modifying the outermost surface region of the surface layer may include plasma treatment or the like. As the result of the examination, it was useful to perform the plasma treatment on the a-C:H film with the high $sp^2$ bonding ratio under the reduced pressure or the atmospheric pressure. As the plasma treatment under the reduced pressure, the plasma treatment using processed gas containing hydrogen gas or oxygen atoms was effective. The plasma treatment using hydrogen gas is considered to lower the $sp^2$ bonding ratio by dissociating a $\pi$ bond of the $sp^2$ bond in the outermost surface region and terminating the dissociated $\pi$ bond with hydrogen.

On the other hand, in the plasma treatment using the processed gas containing the oxygen atoms, the oxygen atoms contained in the processed gas containing the oxygen atoms form ether bond or ketone by dissociating the $\pi$ bond of the $sp^2$ bond in the outermost surface region, and as a result it is considered that the $sp^2$ bonding ratio is lowered. When the ratio of the number of oxygen atoms (O) to the sum of the number of oxygen atoms (O), the number of hydrogen atoms (H), and the number of carbon atoms (C) is defined as the oxygen content ratio, it is preferable that the maximum value of the oxygen content ratio in the outermost surface region after the plasma treatment is 0.15 or more. Examples of the processed gas containing the oxygen atoms may include oxygen ($O_2$), ozone ($O_3$), steam ($H_2O$), carbon monoxide (CO), carbon dioxide ($CO_2$), nitrogen monoxide (NO), and the like.

In addition, as the plasma treatment under the atmospheric pressure, there is a method for making negative corona discharge treatment in the atmosphere effective. For the negative corona discharge treatment in the atmosphere, negative ions with high oxidizing power such as nitrate ions generated by the negative corona discharge dissociate the $\pi$ bond of the $sp^2$ bond in the outermost surface region. At the same time, the oxygen atoms contained in the negative ions form the ether bond or the ketone, and as a result, it is considered that the $sp^2$ bonding ratio is lowered.

The analysis of the $sp^2$ bonding ratio in the outermost surface region of the surface layer can be performed by a method to be described later.

The outermost surface region of the surface layer is a region having a depth of 5 nm or less from the outermost surface of the surface layer. This is because good image resolving power can be obtained if the region having a depth of 5 nm or less from the outermost surface of the surface layer is adjusted to an appropriate $sp^2$ bonding ratio.

In the case of forming the outermost surface region of the surface layer by laminating the a-C:H film having different hydrogen content ratios, by controlling the film formation rate and the film formation time at the time of forming the outermost surface region, the film thickness can be controlled. On the other hand, when the outermost surface region is formed by the surface treatment, it is considered that the reaction is accompanied by etching by a hydrogen gas or a gas containing oxygen atoms, and it is difficult to set the outermost surface region to be thicker than the lamination method.

For example, when the outermost surface region is formed by the oxidation treatment, the depth of the outermost surface region can be measured by the following method.

The measurement of the depth of the outermost surface region can be obtained by using a cross sectional transmission electron microscope (cross sectional TEM), and the information on the composition ratio can be obtained by using an energy dispersive X-ray analyzer (EDX).

The photosensitive member formed with the outermost surface region of the surface layer is cut to 1 cm square and installed in a focused ion beam processing observation apparatus (FIB, FB-2000C manufactured by Hitachi Ltd.) to perform micro sampling. The cross section was observed with a field emission electron microscope (HRTEM, JEM 2100F manufactured by JEOL Ltd.). In addition, the composition distribution of carbon atoms, silicon atoms, and oxygen atoms in the cross section was obtained by characteristic X-rays using the energy dispersive X-ray analyzer (EDX, JED-2300T manufactured by JEOL Ltd.). As the measurement conditions, an accelerating voltage was 200 kV, a point analysis time of the EDX was 30 to 40 seconds, and a beam diameter was 1 nmΦ. First, a bright field (BF) image and a high angle annular dark field (HAADF) image are obtained by a cross sectional scanning TEM (STEM). The BF-STEM image shows a step contrast at an interface, and the HAADF-STEM image relatively reflects a contrast due to a composition difference. From these, it is possible to specify a position of a depth of 5 nm from the outermost surface of the surface layer, and obtain information on the composition distribution of the outermost surface region from the outermost surface to the depth of 5 nm. Also, by using the information and an X-ray photoelectron spectroscopy (XPS, VersaProbe II manufactured by ULVAC-PHI, Inc.), it is also possible to analyze a bonded state of each atom in a film thickness direction. Since by performing argon sputtering by the XPS, the composition analysis is also performed while the outermost surface region of the surface layer is chipped little by little, the sputtering rate of the argon sputter can be calculated by combining with the information obtained by the cross sectional TEM. By using the sputtering rate, the bonded state between each atom in the film thickness direction can be analyzed.

(Intermediate Layer)

There is no limit to the intermediate layer, but it is necessary to select materials considering matching between the surface layer and the photoconductive layer. When the a-C:H surface layer is formed on the a-Si:H photoconductive layer, hydrogenated amorphous silicon carbide is preferably used as a material of the intermediate layer. Hereinafter, the hydrogenated amorphous silicon carbide is also referred to as "a-SiC:H".

The photocarriers generated in the photoconductive layer by the exposure can easily move to the surface layer by optimizing the composition of the a-SiC:H intermediate layer.

In addition, a layer in which the ratio of the number of carbon atoms to the sum of the number of carbon atoms and the number of silicon atoms that form the a-SiC:H intermediate layer is changed stepwise is provided in plural, or a layer in which the ratio of the number of carbon atoms to the sum of the number of carbon atoms and the number of silicon atoms that form the a-SiC:H intermediate layer is changed continuously is provided, thereby improving the movement of the above-described photocarriers. In addition, by making the intermediate layer into a plurality of layers or continuously changing the composition, the reflection of light generated at the interface between the surface layer and the intermediate layer and the interface between the intermediate layer and the photoconductive layer can be controlled. As a result, it is also possible to suppress the fluctuation of the sensitivity characteristic due to the fluctuation in the reflection characteristics caused by the decrease in the film thickness of the surface layer occurring when the photosensitive member is used for a long time.

In the case of the electrophotographic photosensitive member for negative charging, it is effective to incorporate atoms belonging to group 13 of the periodic table in the a-SiC intermediate layer in order to improve charge injection blocking ability. Among the atoms belonging to group 13 of the periodic table, boron atoms, aluminum atoms and gallium atoms are preferred. Hereinafter, the intermediate layer with the charge injection blocking ability is also referred to as an "upper blocking layer".

(Photoconductive Layer)

Any photoconductive layer may be used as long as it has photoconductive properties that can satisfy the performance in the electrophotographic characteristics, but from the viewpoint of durability and stability, a photoconductive layer made of hydrogenated amorphous silicon is preferred.

When the photoconductive layer made of the hydrogenated amorphous silicon is used as the photoconductive layer, in order to compensate for dangling bonds in a-Si, halogen atoms can be contained in addition to hydrogen atoms.

The total content (H+X) of the content of hydrogen atoms (H) and halogen atoms (X) is preferably 10 atomic % or more with respect to the sum (Si+H+X) of the silicon atoms (Si), the hydrogen atoms (H), and the halogen atoms (X), and more preferably 15 atomic % or more. On the other hand, the total content (H+X) of the content of the hydrogen atoms (H) and the halogen atoms (X) is preferably 30 atomic % or less, and more preferably 25 atomic % or less.

The photoconductive layer preferably contains atoms for controlling conductivity, if necessary. The atoms for controlling the conductivity may be contained while being evenly distributed in the photoconductive layer. In addition, there may be a portion which is contained in the film thickness direction in a non-uniform distribution state.

Examples of the atoms for controlling the conductivity may include so-called impurities in the semiconductor field. That is, it is possible to use atoms belonging to group 13 of the periodic table which gives p-type conductivity or atoms belonging to group 15 of the periodic table which gives n-type conductivity. Among the atoms belonging to the group 13 of the periodic table, boron atoms, aluminum atoms, and gallium atoms are preferred. Among the atoms belonging to the group 15 of the periodic table, phosphorus atoms and arsenic atoms are preferred.

The content of atoms for controlling the conductivity contained in the photoconductive layer is preferably $1\times10^{-2}$ atomic ppm or more with respect to the silicon atom (Si). On the other hand, the content of atoms for controlling the conductivity is preferably $1\times10^{2}$ atomic ppm or less.

The film thickness of the photoconductive layer is preferably 15 μm or more and 60 μm or less from the viewpoint of economic efficiency and the like such as the desired electrophotographic characteristics. Since the film thickness of the photoconductive layer is 15 μm or more, the amount of current passing through the charging member is not increased and degradation in the photoconductive layer can be suppressed.

If the film thickness of the photoconductive layer is 60 μm or less, it is possible to suppress an abnormal growth portion of a-Si from greatly increasing. Specifically, it is possible to avoid the growing to 50 to 150 μm in a horizontal direction and to 5 to 20 μm in a height direction, and it is possible to prevent damage to a member rubbing the surface due to the abnormal growth and to prevent image defects.

The photoconductive layer may be constituted by a single layer or may be constituted by a plurality of layers (for example, a charge generation layer and a charge transport layer).

(Lower Charge Injection Blocking Layer)

A lower charge injection blocking layer having a function that blocks the injection of charges from the substrate side is preferably provided between the substrate and the photoconductive layer. The lower charge injection blocking layer is hereinafter also referred to as a "lower blocking layer". That is, the lower blocking layer is a layer having a function of blocking the injection of charges from the substrate to the photoconductive layer when the surface of the electrophotographic photosensitive member is charged with a constant polarity. In order to impart such a function, the lower blocking layer is based on the material constituting the photoconductive layer, and contains a relatively larger amount of atoms for controlling conductivity than that of the photoconductive layer.

The atoms contained in the lower blocking layer to control the conductivity may be contained while being evenly distributed in the lower blocking layer. In addition, there may be a portion which is contained in the film thickness direction in a non-uniform distribution state. When the distribution concentration is non-uniform, it is preferable to contain the atoms so that more atoms are distributed on the substrate side. In any case, it is preferable that the atoms for controlling the conductivity are contained in the lower blocking layer in a uniform distribution in a plane direction parallel to the surface of the substrate from the viewpoint of making the characteristics uniform.

As the atoms contained in the lower blocking layer for controlling the conductivity, the atoms belonging to group 13 or 15 of the periodic table can be used depending on the charging polarity.

In addition, it is possible to improve an adhesion between the lower blocking layer and the substrate by containing at least one atom of carbon atoms, nitrogen atoms, and oxygen atoms in the lower blocking layer.

At least one kind of atoms among the carbon atoms, the nitrogen atoms, and the oxygen atoms contained in the lower blocking layer may be contained while being evenly distributed over the whole of the lower blocking layer. In addition, though the atoms are entirely contained in the film thickness direction, there may be a portion contained in a non-uniformly distributed state. In any case, it is preferable that the atoms for controlling the conductivity are contained in the charge injection blocking layer in a uniform distribution in a plane direction parallel to the surface of the substrate from the viewpoint of making the characteristics uniform.

The film thickness of the lower blocking layer is preferably 0.1 μm or more and 10 μm or less, and more preferably 0.3 μm or more and 5 μm or less, from the viewpoint of obtaining desired electrophotographic characteristics, economic efficiency and the like. By setting the film thickness to be 0.1 μm or more, the lower blocking layer can sufficiently have the ability to block the injection of charges from the substrate, and obtain the charging ability. On the other hand, by setting the film thickness to be 10 μm or less, it is possible to prevent an increase in manufacturing costs due to the extension of the lower blocking layer formation time.

(Conductive Substrate)

The conductive substrate is not particularly limited as long as it can hold the photoconductive layer and the surface layer formed on the surface, and any conductive substrate may be used. Examples of the material of the substrate may include metals such as aluminum and iron, alloys thereof, and the like. The conductive substrate is hereinafter referred to as a "substrate".

<Electrophotographic Apparatus Including Electrophotographic Photosensitive Member According to the Present Invention>

Figure 2:
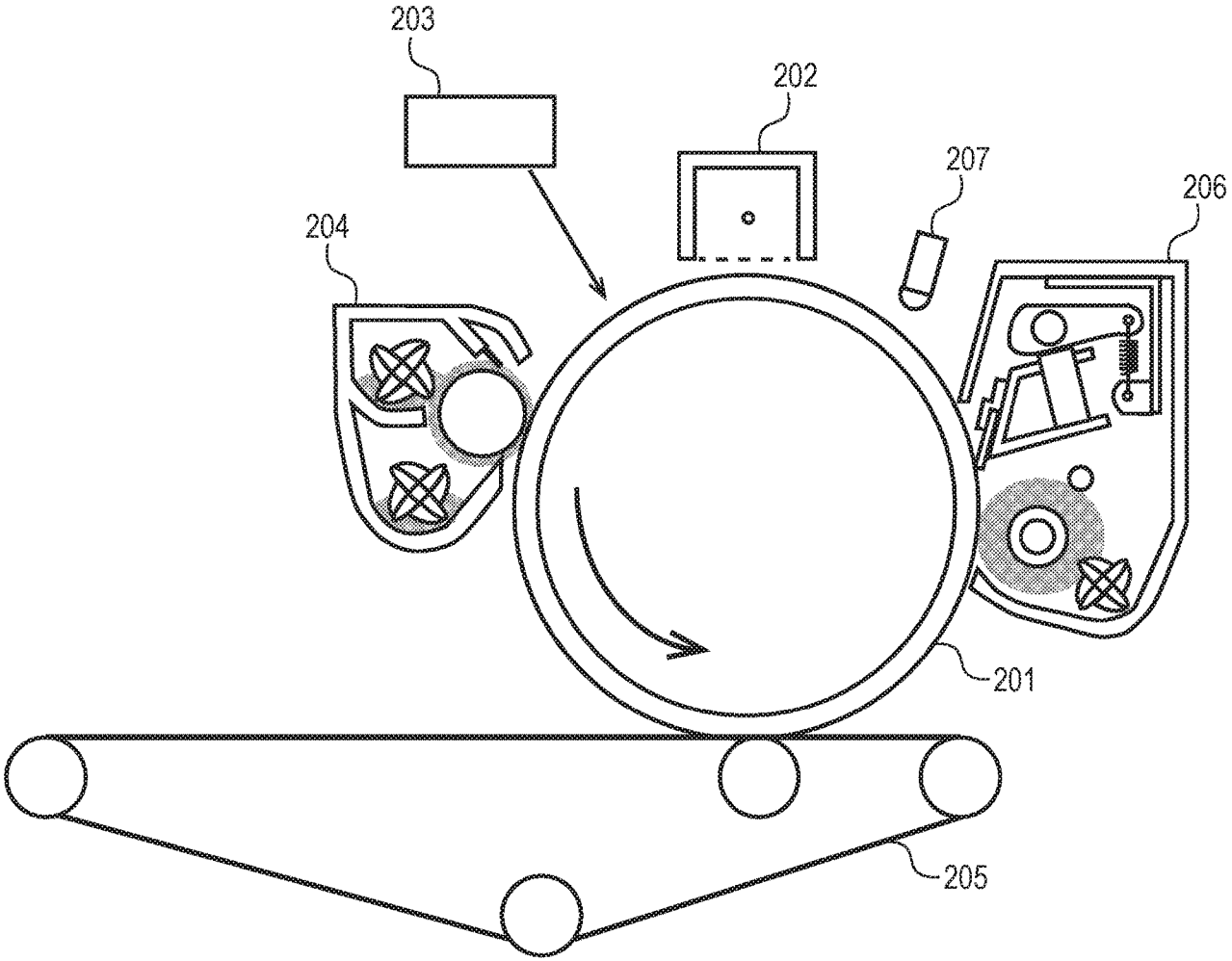
FIG. 2 is a schematic cross-sectional view of an electrophotographic apparatus including the electrophotographic photosensitive member according to the present invention.

An image forming method using an electrophotographic apparatus using an electrophotographic photosensitive member according to the present invention will be described with reference to FIG. 2.

First, an electrophotographic photosensitive member 201 is rotated, and a surface of the electrophotographic photosensitive member 201 is uniformly charged by a main charger (charging unit) 202. Thereafter, an electrostatic latent image forming unit (exposure unit) 203 irradiates the surface of the electrophotographic photosensitive member 201 with image exposure light and forms an electrostatic latent image on the surface of the electrophotographic photosensitive member 201, and then a developing device (developing unit) 204 performs development using a toner supplied. As a result, a toner image is formed on the surface of the electrophotographic photosensitive member 201.

The toner image is transferred to an intermediate transfer body 205 which is an example of a transfer unit, secondarily transferred from the intermediate transfer body 205 to a transfer material (not shown) such as paper, and then fixed on the transfer material by a fixing unit (not shown).

On the other hand, the toner remaining on the surface of the electrophotographic photosensitive member 201 to which the toner image is transferred is removed by a cleaner (cleaning unit) 206, and then the surface of the electrophotographic photosensitive member 201 is exposed by a pre-exposing device 207. By doing so, carriers remaining in the electrostatic latent image in the electrophotographic photosensitive member 201 are destaticized. By repeating this series of processes, the image formation is continuously performed.

<Apparatus and Method for Manufacturing Electrophotographic Photosensitive Member According to the Present Invention>

As a method for manufacturing an electrophotographic photosensitive member according to the present invention, any method may be used as long as it is capable of forming a layer satisfying the above-mentioned requirements. Specific examples of the method may include a plasma CVD method, a vacuum deposition method, a sputtering method, an ion plating method, and the like. Among them, the plasma CVD method is preferable from the viewpoint of availability of raw material supply and the like.

A manufacturing apparatus and a manufacturing method using a plasma CVD method will be described below.

Figure 3:
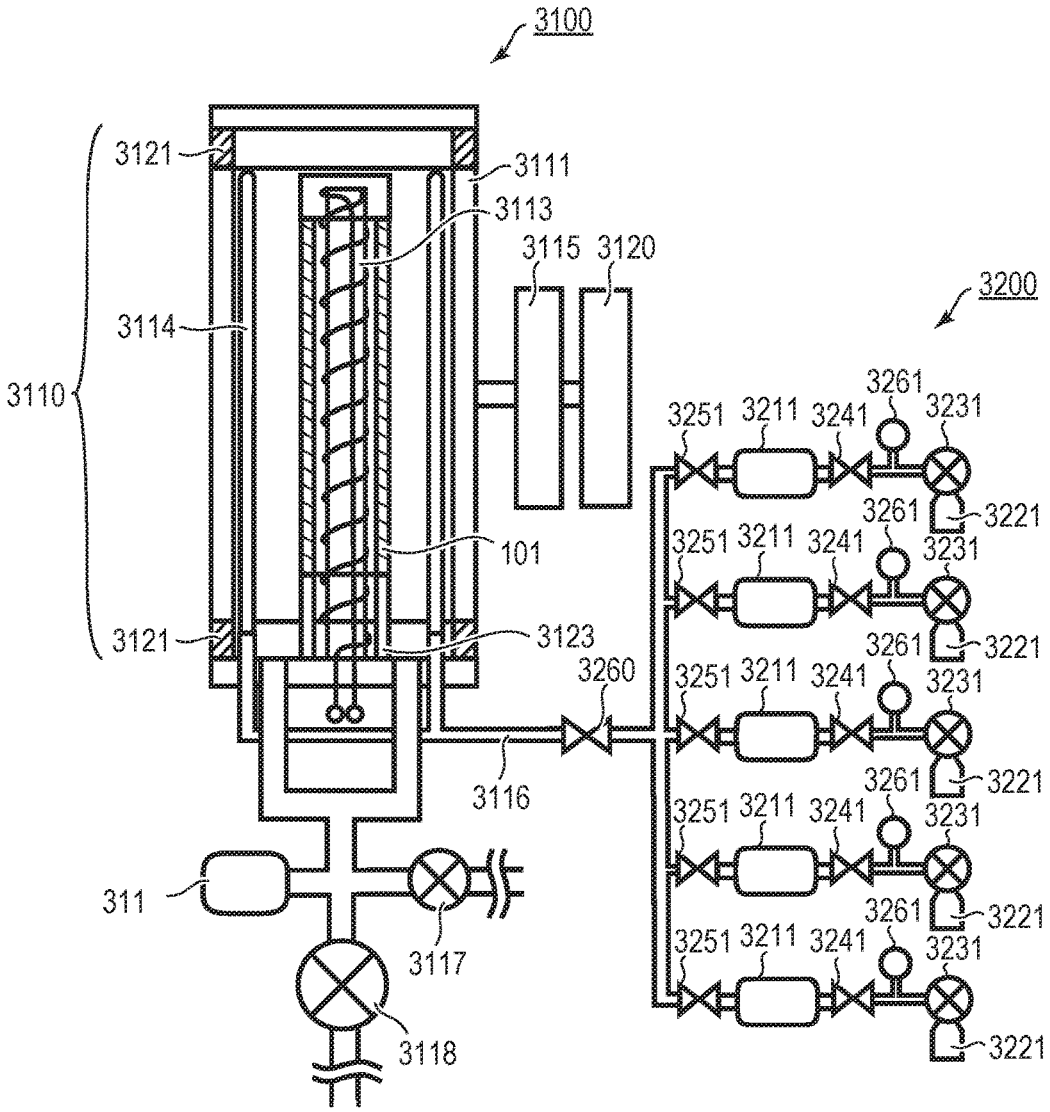
FIG. 3 is a schematic cross-sectional view of an apparatus for manufacturing an electrophotographic photosensitive member according to the present invention.

FIG. 3 is a view schematically showing an example of a deposition apparatus by an RF plasma CVD method using a high frequency power supply for manufacturing an electrophotographic photosensitive member according to the present invention.

The deposition apparatus is largely divided into a deposition apparatus 3100 having a reaction vessel 3110, a raw material gas supply device 3200, and an exhaust apparatus (not shown) for decompressing an inside of the reaction vessel 3110.

The inside of the reaction vessel 3110 in the deposition apparatus 3100 is provided with a substrate 101 connected to a ground, a heater 3113 for heating the substrate, and a raw material gas introduction pipe 3114. In addition, a high frequency power supply 3120 is connected to a cathode electrode 3111 via the high frequency matching box 3115.

The raw material gas supply device 3200 includes a raw material gas cylinder 3221, a valve 3231, a pressure regulator 3261, an inflow valve 3241, an outflow valve 3251, and a mass flow controller 3211. A gas cylinder sealed with each raw material gas is connected to a raw material gas introduction pipe 3114 in the reaction vessel 3110 via an auxiliary valve 3260. Reference numeral 3116 is a gas pipe, reference numeral 3117 is a leak valve, and reference numeral 3121 is an insulating material.

Next, a method for forming a deposited film using the apparatus will be described. First, the substrate 101 which is degreased in advance is installed in the reaction vessel 3110 via a cradle 3123. Next, the exhaust device (not shown) is operated to exhaust the inside of the reaction vessel 3110. While an indication of a vacuum gauge 3119 is watched, when the pressure in the reaction vessel 3110 reaches a predetermined pressure of, for example, 1 Pa or less, power is supplied to the heater 3113 for heating the substrate, and the substrate 101 is heated to a predetermined temperature of 50 to 350° C. At this time, the raw material gas supply device 3200 supplies inert gases such as Ar and He to the reaction vessel 3110 and can perform the heating under the inert gas atmosphere.

Next, the raw material gas supply device 3200 supplies a gas used for forming the deposited film to the reaction vessel 3110. That is, if necessary, the valve 3231, the inflow valve 3241, and the outflow valve 3251 are opened, and the mass flow controller 3211 sets the flow rate. When the flow rates of each mass flow controllers are stabilized, the main valve 3118 is operated while watching the indication of the vacuum gauge 3119 to adjust the pressure in the reaction vessel 3110 to a desired pressure.

When the desired pressure is obtained, the high frequency power supply 3120 applies high frequency power and at the same time operates the high frequency matching box 3115 to generate a plasma discharge in the reaction vessel 3110. Thereafter, the high frequency power is promptly adjusted to desired power, and the deposited film is formed.

When the formation of the predetermined deposited film is completed, the application of the high frequency power is stopped, the valve 3231, the inflow valve 3241, the outflow valve 3251, and the auxiliary valve 3260 are closed, and the supply of the raw material gas is completed. At the same time, the main valve 3118 is fully opened, and the inside of the reaction vessel 3110 is exhausted to a pressure of 1 Pa or less.

Hereinabove, the formation of the deposited film is completed, but in the case of forming a plurality of deposited films, the above-mentioned procedure may be repeated to form each layer. It is also possible to form a bonding region by changing the photoconductive layer forming conditions such as the flow rate of raw material gas and the pressure for a certain period of time.

After the formation of all the deposited films is completed, the main valve 3118 is closed, the inert gas is introduced into the reaction vessel 3110 and returned to the atmospheric pressure, and then the substrate 101 is taken out.

In the formation of the a-C:H surface layer, as a raw material gas for supplying carbon atoms, gases such as methane ($CH_4$), ethane ($C_2H_6$), propane ($C_3H_8$), butane ($C_4H_{10}$), ethylene ($C_2H_4$), and acetylene ($C_2H_2$) can be suitably used. Hydrogen ($H_2$) or helium (He) is useful as a dilution gas.

In order to adjust the hydrogen content ratio of the a-C:H surface layer, it is necessary to optimize control parameters such as the flow rate of the raw material gas, the reaction pressure, the high frequency power, the substrate temperature, the flow rate of the dilution gas, and the like. The flow rate of the raw material gas was decreased, the reaction pressure was decreased, the high frequency power was increased, the substrate temperature was increased, or the flow rate of the dilution gas was increased to tend to decrease the hydrogen content ratio.

In the formation of the intermediate layer, as the raw material gases for supplying silicon atoms, silanes such as silane ($SiH_4$) and disilane ($Si_2H_6$) can be suitably used. The intermediate layer is formed by setting the conditions such as the flow rate of the raw material gas to be supplied to the reaction vessel, the high frequency power, the pressure in the reaction vessel, and the temperature of the substrate, if necessary. In order to impart the charge injection blocking ability to the intermediate layer, raw material gases containing atoms belonging to group 13 or 15 of the periodic table are added according to the charge polarity to form the intermediate layer. Examples of the raw material gases containing the atoms belonging to the group 13 or 15 of the periodic table may include diborane ($B_2H_6$), phosphine ($PH_3$), and the like.

In the formation of the photoconductive layer, as the raw materials for supplying the silicon atoms, silanes such as silane ($SiH_4$) and disilane ($Si_2H_6$) can be suitably used. Further, as raw material gases for supplying hydrogen atoms, in addition to the above-mentioned silanes, for example, hydrogen ($H_2$) Can also be suitably used.

In addition, in the case where the halogen atoms described above, atoms for controlling conductivity, carbon atoms, oxygen atoms, nitrogen atoms, and the like are included in the photoconductive layer, gaseous or easily gasified substances containing each atom may be appropriately used as a material.

According to the present invention, in the electrophotographic photosensitive member having the photoconductive layer and the surface layer made of the hydrogenated amorphous carbon on the photoconductive layer, it is possible to satisfy both good barrier property and good image resolving power.

EXAMPLE

Example 1 and Comparative Example 1

In Example 1 and Comparative Example 1, the lower blocking layer, the photoconductive layer, and the upper blocking layer were sequentially formed on a cylindrical substrate using the plasma CVD apparatus of FIG. 3 under the conditions shown in Table 1 below. Subsequently, as Examples 1-1 to 1-7 and Comparative Examples 1-1 to 1-3, the surface layer was formed under the conditions shown in the following Table 2 for the kinds and the flow rates of the gases used for forming the surface layer, the reaction pressure, the high frequency power, the substrate temperature, and the film thickness. In addition, 10 photosensitive members having the layer configuration of FIG. 1B were manufactured by modifying the outermost surface region under the conditions shown in the following Table 3, and were added to one photosensitive member of Comparative Example 1-4 in which the surface layer was formed to manufacture a total of 11 a-Si photosensitive members for negative charging. As the cylindrical substrate, a cylindrical conductive substrate made of aluminum which has a diameter of 84 mm, a length of 371 mm, and a thickness of 3 mm and is subjected to mirror finishing was used.

TABLE 1

| | Lower blocking layer | Photoconductive layer | Upper blocking layer |
|---|---|---|---|
| Kind and flow rate of gas | | | |
| $SiH_4$ [ml/min · (normal)] | 300 | 300 | 150 |
| $H_2$ [ml/min · (normal)] | 480 | 680 | |
| $B_2H_6$ [ppm] (based on $SiH_4$) | | | 150 |
| NO [ml/min · (normal)] | 5 | | |
| $CH_4$ [ml/min · (normal)] | 100 | | 200 |
| Reaction pressure [Pa] | 40 | 80 | 53 |
| High frequency power [W] | 200 | 600 | 400 |
| Substrate temperature [° C.] | 270 | 260 | 240 |
| Film thickness [μm] | 2.5 | 35 | 0.2 |

TABLE 3

| Outermost surface region treating condition | A1 |
|---|---|
| Kind and flow rate of gas | |
| $O_2$ [ml/min · (normal)] | 0 |
| $H_2$ [ml/min · (normal)] | 300 |
| Reaction pressure [Pa] | 100 |
| High frequency power [W] | 300 |
| Substrate temperature [° C.] | 25 |
| Treatment time [min.] | 10 |

TABLE 2

| | Example | | | | | | | Comparative Example | | | |
|---|---|---|---|---|---|---|---|---|---|---|---|
| | 1-1 | 1-2 | 1-3 | 1-4 | 1-5 | 1-6 | 1-7 | 1-1 | 1-2 | 1-3 | 1-4 |
| Surface layer forming condition | S1 | S2 | S3 | S4 | S7 | S9 | S10 | S5 | S6 | S8 | None |
| Kind and flow rate of gas | | | | | | | | | | | |
| $CH_4$ [ml/min.(normal)] | 25 | 50 | 150 | 50 | 50 | 50 | 50 | 50 | 50 | 50 | — |
| $H_2$ [ml/min.(normal)] | 0 | 0 | 0 | 0 | 0 | 0 | 500 | 0 | 0 | 0 | — |
| Reaction pressure [Pa] | 50 | 50 | 50 | 25 | 50 | 50 | 50 | 80 | 50 | 50 | — |
| High frequency power [W] | 400 | 400 | 400 | 400 | 600 | 400 | 400 | 400 | 200 | 400 | — |
| Substrate temperature [° C.] | 240 | 240 | 240 | 240 | 240 | 280 | 240 | 240 | 240 | 200 | — |
| Film thickness [nm] | 100 | 100 | 100 | 100 | 100 | 100 | 100 | 100 | 100 | 100 | — |

The "hydrogen content ratio" of the surface layer of the manufactured a-Si photosensitive member and the "$sp^2$ bonding ratio" in the outermost surface region of the surface layer were evaluated by a specific method to be described below. In addition, as the characteristics of the manufactured a-Si photosensitive member, the image resolving power and the barrier property were evaluated by a specific method to be described below. The evaluation results are shown in Table 4.

(Measurement of Hydrogen Content Ratio of Surface Layer)

A sample for measurement was cut out from the manufactured photosensitive member and installed in Pelletron 3SDH (Manufactured by National Electrostatics Corporation). The number of atoms of carbon atoms and silicon atoms in the surface layer on the measurement surface of Rutherford backscattering method (RBS) was measured by the RBS. In addition, simultaneously with the RBS, the number of atoms of hydrogen atoms in the surface layer on the measurement surface of a hydrogen forward scattering method (HFS) was measured by the HFS. Specific measurement conditions of the RBS are incident ion: $4He^{++}$, incident energy: 2.3 MeV, incident angle: 75°, sample current: 21 nA, and incident beam diameter: 2 mm. In addition, a detector of the RBS performed measurement at scattering angle: 160° and aperture diameter: 8 mm, a detector of the HFS performed measurement at recoil angle: 30°, and aperture diameter: 8 mm+Slit.

The hydrogen content ratio of the surface layer was obtained based on the number of atoms of carbon atoms and hydrogen atoms measured. A region in which a ratio of silicon atoms is less than 1% based on the number of atoms of carbon atoms, silicon atoms and hydrogen atoms measured is defined as a surface layer region, and for the surface layer region defined, the hydrogen content ratio is calculated based on the number of atoms of carbon atoms and hydrogen atoms. In addition, the measurement is performed on 10 points in the film thickness direction in the sample and an arithmetic average of the obtained value is calculated, such that the average value of the hydrogen content ratio of the surface layer was determined.

(Measurement of Hydrogen Content Ratio in Outermost Surface Region)

The number of atoms of carbon atoms and hydrogen atoms was measured in the outermost surface region by the same method as the measurement of the hydrogen content ratio of the surface layer, and the hydrogen content ratio was calculated based on the number of atoms of the carbon atoms and hydrogen atoms measured. The measurement was performed in the film thickness direction of the outermost surface region to calculate the hydrogen content ratio, and the maximum value of the hydrogen content in the outermost surface region was determined.

(Measurement of $sp^2$ Bonding Ratio)

The sample for measurement was cut out based on the manufactured photosensitive member and installed in a measurement position in X-ray photoelectron spectroscopy (XPS, VersaProbe.II manufactured by ULVAC-PHI). Thereafter, the X-ray was irradiated and excited electrons emitted by the irradiated X-ray were received by the detector, and a ratio of an orbital state of electrons of the carbon atoms included in the outermost surface region of the surface layer was calculated based on binding energy spectrum of the number of excited electrons received per unit time.

Specifically, a binding energy range that can be taken by the excited electrons from is orbital of the carbon atoms is limited to 278 eV or more and 298 eV or less and thus binding energy spectrum was measured. By doing so, spectral data with high resolution can be obtained within a realistic measurement time.

At this time, in the carbon atoms taking a $sp^2$ hybridized orbital, the excited electrons from the is orbital have a binding energy of 284.4 eV as a peak, while in the carbon atoms taking a $sp^3$ hybridized orbital, the excited electrons from the 1 s orbital have a binding energy of 285.1 eV as a peak. From this, fitting (waveform separation) was performed on the binding energy spectrum of the excited electrons from the 1 s orbital of the carbon atoms actually measured by superposition of distribution functions having peaks at binding energies of 284.4 eV and 285.1 eV. For each distribution function, a distribution function obtained by the convolution of the Lorenz distribution function and the Gaussian distribution function was used.

The $sp^2$ bonding ratio was calculated based on an integrated value (area) for the binding energies of each of the distribution functions corresponding to the fitted $sp^2$ hybridized orbital and $sp^3$ hybridized orbital. In addition, by performing argon sputtering, the outermost surface region of the surface layer was cut little by little, and the above-mentioned measurement was repeated until the outermost surface region of the surface layer was completely removed. In this way, the maximum value of the $sp^2$ bonding ratio in the outermost surface region of the surface layer was obtained.

(Evaluation of Image Resolving Power)

The evaluation of the image resolving power was performed using a remodeling machine of a digital electrophotographic apparatus "image.RUNNER.ADVANCE.C7065" (trade name) manufactured by Canon Inc. The remodeling machine was configured to be able to apply primary charging and developing bias from an external power supply. In addition, the remodeling machine was configured to be able to directly output the image data without going through a printer driver. In addition, an area gradation image (that is, an area gradation of a dot portion to be subjected to image exposure) of an area gradation dot screen could be output at a line density of 45° 212 lpi (212 lines per inch) by the image exposure light.

The manufactured photosensitive member was mounted on a Bk station of a digital electrophotographic apparatus "image.RUNNER.ADVANCE.C7065", and adjusted a primary current of the primary charging and a grid voltage so that a dark part surface potential of the photosensitive member was set to be −500 V. Next, the image exposure light was irradiated in a state of being charged under the previously set charging conditions, and the potential at the position of the developing device was set to be −150 V by adjusting the irradiation energy.

In the area gradation image, gradation data equally distributed in 17 levels was used. At this time, numbers are assigned to each gradation with the darkest gradation of 16 and the lightest gradation as 0, which was set to be a gradation level.

Next, the manufactured photosensitive member was mounted in the remodeled electrophotographic apparatus, and the gradation data was output to A3 paper using a texture mode. In order to exclude the influence of a high humidity flow, an image was output under the condition that the surface of the photosensitive member was kept at about 40° C. by turning on the photosensitive member heater under the environment of a temperature of 22° C. and a relative humidity of 50%.

The image density of the obtained image was measured for each gradation using a reflection densitometer (manufactured by X-Rite Inc.: 504. spectral densitometer). In the reflection density measurement, three images were output for each gradation, and the average value of the densities was used as the evaluation value.

The correlation coefficient between the evaluation value thus obtained and the gradation level was calculated, and a difference from the correlation coefficient=1.00 which is the case of obtaining a gradation expression in which the reflection densities of each gradation are completely changed linearly was obtained. The ratio of the difference for the photosensitive member manufactured under each film forming condition to the difference for the photosensitive member manufactured in Comparative Examples 1-4 was evaluated as an index of the image resolving power. From this evaluation, it is shown that the smaller the numerical value, the better the image resolving power becomes.

A The ratio of the difference for the photosensitive member manufactured under each film forming condition to the difference for the photosensitive member manufactured in Comparative Example 1-4 is 0.50 or less.

B The ratio of the difference for the photosensitive member manufactured under each film forming condition to the difference for the photosensitive member manufactured in Comparative Example 1-4 is larger than 0.50 and 0.65 or less.

C The ratio of the difference for the photosensitive member manufactured under each film forming condition to the difference for the photosensitive member manufactured in Comparative Example 1-4 is larger than 0.65 and 0.80 or less.

D The ratio of the difference for the photosensitive member manufactured under each film forming condition to the difference for the photosensitive member manufactured in Comparative Example 1-4 is larger than 0.80.

(Evaluation of Barrier Property)

A corotron charger (charging width 50 mm) and a light source were mounted to supply a constant current (−50 μA) to a charging wire of the corotron charger while applying light so that the surface of the manufactured photosensitive member was exposed to a corona discharge. The exposure by the corona discharge was carried out for 5 hours, and then a sample was cut from the exposed part of the photosensitive member.

above, the negative ions containing oxygen and the discharge products permeate through the surface layer and reach the upper blocking layer which is the layer under the surface layer, and silicon, which is the main component of the upper blocking layer, is oxidized. As a result, in the layer thickness direction distribution of O/(C+O+Si), O/(C+O+Si) is increased from the vicinity of the interface of the upper blocking layer. That is, when O/(C+O+Si) is increased from the vicinity of the interface of the upper blocking layer, it can be determined that there is no barrier property of the surface layer.

The case where there is the barrier property was evaluated as A, and the case where there is no barrier property was evaluated as C. It was determined that the effect of the present invention was obtained at rank A.

(Comprehensive Evaluation)

The lowest evaluation results of the evaluated items were adopted. It was determined that the effect of the present invention was obtained at rank B or more.

TABLE 4

| | Example | | | | | | | Comparative Example | | |
|---|---|---|---|---|---|---|---|---|---|---|
| | 1-1 | 1-2 | 1-3 | 1-4 | 1-5 | 1-6 | 1-7 | 1-1 | 1-2 | 1-3 |
| Surface layer forming condition | S1 | S2 | S3 | S4 | S7 | S9 | S10 | S5 | S6 | S8 |
| Evaluation item | | | | | | | | | | |
| $sp^2$ bonding ratio in outermost surface region | 0.44 | 0.38 | 0.33 | 0.41 | 0.47 | 0.44 | 0.50 | 0.20 | 0.25 | 0.30 |
| Hydrogen content ratio in outermost surface region | 0.45 | 0.47 | 0.49 | 0.46 | 0.44 | 0.45 | 0.42 | 0.57 | 0.53 | 0.50 |
| Hydrogen content ratio of surface layer | 0.36 | 0.38 | 0.40 | 0.37 | 0.35 | 0.36 | 0.33 | 0.48 | 0.44 | 0.41 |
| Barrier property | A | A | A | A | A | A | A | C | C | C |
| Image resolving power | A | A | A | A | B | A | B | A | A | A |
| Comprehensive evaluation | A | A | A | A | B | A | B | C | C | C |

The sample is introduced into the measurement position in the X-ray photoelectron spectrometer (XPS) (VersaProbe.II manufactured by ULVAC-PHI). Thereafter, the X-ray was irradiated and the excited electrons emitted by the irradiated X-ray were received by the detector, and the ratio of the number of atoms included in the photosensitive member was calculated based on the binding energy spectrum of the number of excited electrons received per unit time.

Specifically, the binding energy spectrum was measured within the binding energy range that can be taken by the excited electrons from the atoms assumed to be included in the photosensitive member. By doing so, the spectral data with high resolution can be obtained within the realistic measurement time. That is, the binding energy spectrum was measured within is orbital (278 eV or more and 298 eV or less) of carbon atoms, is orbital (523 eV or more and 543 eV or less) of oxygen atoms, and 2p orbital of silicon atoms (97 eV or more and 108 eV or less). For each atom, the ratio (O/(C+O+Si) of the number of oxygen atoms (O) to the sum of the number of carbon atoms (C), the number of oxygen atoms (O), and the number of silicon atoms (Si) was calculated based on the integrated value (area) for the binding energy of the number of excited electrons detected per unit time.

Then, by performing the argon sputtering, the layer thickness direction distribution of O/(C+O+Si) was obtained by repeating the above-mentioned measurement while from the surface layer of the photosensitive member to a part of the upper blocking layer which is the layer under the surface layer is chipped little by little.

In the absence of the barrier property of the surface layer, due to the exposure by the corona discharge described As the evaluation result, the barrier property was obtained in all of the photosensitive members of this example in which the hydrogen content ratio of the surface layer of 0.40 or less. In addition, by setting the hydrogen content ratio in the outermost surface region to be 0.45 or more, the $sp^2$ bonding ratio became 0.50 or less, the good image resolving power was obtained, and the barrier property and the image resolving power could be compatible with each other.

Example 2 and Comparative Example 2

In Example 2 and Comparative Example 2, similar to Example 1, the lower blocking layer, the photoconductive layer, and the upper blocking layer were sequentially formed by using the plasma CVD apparatus of FIG. 3 under the conditions shown in the above Table 1. Subsequently, the surface layer was laminated under the formation conditions of S2. In addition, in Examples 2-1 to 2-3 and Comparative Examples 2-1 and 2-2, the outermost surface region was formed on the surface layer under five conditions shown in Table 5, and five a-Si photosensitive members were manufactured.

TABLE 5

| | Example | | | Comparative Example | |
|---|---|---|---|---|---|
| | 2-1 | 2-2 | 2-3 | 2-1 | 2-2 |
| Outermost surface region forming conditions | B1 | B2 | B3 | B4 | B5 |

TABLE 5-continued

| | Example | | | Comparative Example | |
|---|---|---|---|---|---|
| | 2-1 | 2-2 | 2-3 | 2-1 | 2-2 |
| Kind and flow rate of gas | | | | | |
| $CH_4$ [ml/min · (normal)] | 200 | 200 | 200 | 200 | 200 |
| $H_2$ [ml/min · (normal)] | 0 | 0 | 0 | 0 | 0 |
| Reaction pressure [Pa] | 25 | 25 | 50 | 50 | 50 |
| High frequency power [W] | 200 | 200 | 200 | 300 | 400 |
| Substrate temperature [° C.] | 200 | 240 | 240 | 240 | 240 |
| Film thickness [nm] | 3 | 3 | 3 | 3 | 3 |

Example, Comparative Example, Outermost surface region forming conditions, Kind and flow rate of gas, Reaction pressure, High frequency power, Substrate temperature, Film thickness, Example, Comparative Example The average value of the "hydrogen content ratio" of the surface layer of the manufactured a-Si photosensitive member and the maximum value of the "$sp^2$ bonding ratio" in the outermost surface region of the surface layer were evaluated by the same method as Example 1. In addition, as the characteristics of the manufactured a-Si photosensitive member, the image resolving power and the barrier property were evaluated by the same method as Example 1. The evaluation results are shown in Table 6.

TABLE 6

| | Example | | | Comparative Example | |
|---|---|---|---|---|---|
| | 2-1 | 2-2 | 2-3 | 1-1 | 1-2 |
| Outermost surface region forming condition | B1 | B2 | B3 | B4 | B5 |
| Evaluation item | | | | | |
| $sp^2$ bonding ratio in outermost surface region | 0.32 | 0.38 | 0.50 | 0.52 | 0.55 |
| Hydrogen content ratio in outermost surface region | 0.49 | 0.47 | 0.42 | 0.41 | 0.39 |
| Hydrogen content ratio of surface layer | 0.38 | 0.38 | 0.38 | 0.38 | 0.38 |
| Barrier property | A | A | A | A | A |
| Image resolving power | A | A | B | C | C |
| Comprehensive evaluation | A | A | B | C | C |

As the evaluation result, the effect of the present invention that the barrier property and the image resolving power were compatible with each other in all of the photosensitive members of this example was confirmed. The method for forming the outermost surface region by laminating the a-C:H surface layers with different characteristics can be implemented by continuous treatment and the treatment time is short, which is a good method in terms of productivity.

Example 3 and Comparative Example 3

In Example 3 and Comparative Example 3, similar to Example 2, the lower blocking layer, the photoconductive layer, and the upper blocking layer were sequentially formed by using the plasma CVD apparatus of FIG. 3 under the conditions shown in the above Table 1, and the surface layer was laminated under the forming conditions of S2. In addition, in Examples 3-1 to 3-4 and Comparative Examples 3-1 and 3-2, six photosensitive members was manufactured by performing the surface treatment under six conditions shown in Table 7 to modify the outermost surface region of the surface layer.

TABLE 7

| | Example | | | | Comparative Example | |
|---|---|---|---|---|---|---|
| | 3-1 | 3-2 | 3-3 | 3-4 | 3-1 | 3-2 |
| Outermost surface region treating condition | A2 | A5 | A6 | A7 | A3 | A4 |
| Kind and flow rate of gas | | | | | | |
| $O_2$ [ml/min.(normal)] | 0 | 300 | 300 | 300 | 0 | 0 |
| $H_2$ [ml/min.(normal)] | 300 | 0 | 0 | 0 | 300 | 300 |
| Reaction pressure [Pa] | 100 | 100 | 100 | 100 | 100 | 100 |
| High frequency power [W] | 300 | 300 | 300 | 300 | 300 | 300 |
| Substrate temperature [° C.] | 25 | 25 | 25 | 25 | 25 | 25 |
| Treatment time [min.] | 5 | 5 | 2 | 1 | 2 | 1 |

The average value of the "hydrogen content ratio" of the surface layer of the manufactured a-Si photosensitive member and the maximum value of the "$sp^2$ bonding ratio" in the outermost surface region of the surface layer were evaluated by the same method as Example 1. In addition, the maximum value of the oxygen content ratio in the outermost surface region of the surface layer was evaluated by the following specific method. In addition, the image resolving power and the barrier property of the manufactured photosensitive member were evaluated by the same method as Example 1. The evaluation results are shown in Table 8.

(Measurement of Oxygen Content Ratio)

After the sample for measurement was cut out from the manufactured photosensitive member and introduced into the measurement position in the XPS (VersaProbe.II manufactured by ULVAC-PHI), the arrangement of the detectors of the excited electrons was inclined by 80° with respect to a normal direction of the surface of the sample for measurement. First, some contaminants attached to the outermost surface are removed by weakly performing the argon sputtering. Thereafter, the X-ray was irradiated and the excited electrons emitted by the irradiated X-ray were received by the detector, and the ratio of the number of oxygen atoms present on the surface of the sample for measurement was calculated based on the received energy distribution. At this time, the measurement was carried out within the binding energy range from 525 eV to 545 eV of the electrons corresponding to the is orbital of the oxygen atoms and the binding energy range from 278 eV to 298 eV of the electrons corresponding to the is orbital of the carbon atoms.

By limiting the binding energy range thus measured to a range corresponding to a specific element, the high resolution can be obtained within the realistic time, such that in the measurement of the ratio of the number of oxygen atoms included, the high precision can be obtained. The content ratio of the oxygen atoms is calculated as the ratio of the area corresponding to the oxygen atoms to the sum of each of the oxygen atoms and the carbon atoms by integrating the count number corresponding to each of the oxygen atoms and the carbon atoms with respect to the binding energy. Next, the surface subjected to the argon sputtering is irradiated again with X-rays to detect the excited electrons, thereby obtaining the content ratio of the oxygen atoms at the depth corresponding to the chipped portion. By repeating this, the content ratio of the oxygen atoms is obtained in the depth direction.

The average value of the "hydrogen content ratio" of the surface layer of the manufactured a-Si photosensitive member, the maximum value of the "$sp^2$ bonding ratio" in the outermost surface region of the surface layer, and the maximum value of the oxygen content ratio in the outermost surface region of the surface layer were evaluated by the same method as Example 3. The image resolving power and the barrier property of the manufactured photosensitive member were evaluated by the same method as in Example 3. The evaluation results are shown in Table 9.

TABLE 8

| | Example | | | | | Comparative Example | |
|---|---|---|---|---|---|---|---|
| | 1-2 | 3-1 | 3-2 | 3-3 | 3-4 | 3-1 | 3-2 |
| Outermost surface region treating condition | A1 | A2 | A5 | A6 | A7 | A3 | A4 |
| Evaluation item | | | | | | | |
| $sp^2$ bonding ratio in outermost surface region | 0.40 | 0.50 | 0.30 | 0.30 | 0.35 | 0.51 | 0.55 |
| Oxygen content ratio in outermost surface region | less than 0.02 | less than 0.02 | 0.21 | 0.21 | 0.15 | less than 0.02 | less than 0.02 |
| Hydrogen content ratio of surface layer | 0.38 | 0.38 | 0.38 | 0.38 | 0.38 | 0.38 | 0.38 |
| Barrier property | A | A | A | A | A | A | A |
| Image resolving power | A | B | A | A | A | C | C |
| Comprehensive evaluation | A | B | A | A | A | C | C |

As the evaluation result, the effect of the present invention that the barrier property and the image resolving power were compatible with each other in all of the photosensitive members of this example was confirmed. It was found that the plasma treatment by the oxygen gas obtains sufficient effects in a shorter treatment time than the plasma treatment by the hydrogen gas.

Example 4 and Comparative Example 4

In Example 4 and Comparative Example 4, similar to Example 2, the lower blocking layer, the photoconductive layer, and the upper blocking layer were sequentially formed by using the plasma CVD apparatus of FIG. 3 under the conditions shown in the above Table 1, and the surface layer was laminated under the forming conditions of S2. In addition, the photosensitive member was manufactured by modifying the outermost surface region was modified by the negative corona discharge in the atmosphere. It should be noted that five photosensitive members were manufactured under five different conditions of treatment time.

Figure 4:
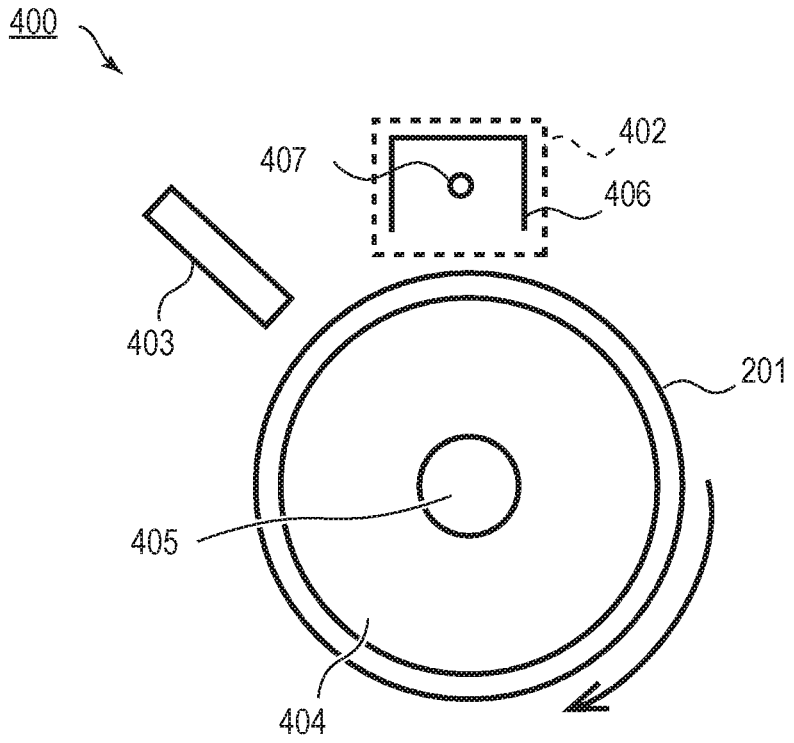
FIG. 4 is a schematic cross-sectional view of a surface treatment apparatus for manufacturing an electrophotographic photosensitive member according to the present invention.

Specifically, according to an apparatus 400 shown in FIG. 4, an outermost surface of the electrophotographic photosensitive member 201 is rotated at a speed of 500 mm/sec by a motor (not shown) via a rotating shaft 405 and a flange 404 in the atmosphere, and a current of −350 μA is supplied to the photosensitive member by a corotron charger 402 having a width of 350 mm in a generating line direction of the photosensitive member, such that surface modification treatment was performed. The current supplied to the photosensitive member controls a difference between a current supplied from a discharge wire 407 and a current sucked into a shield 406. When the current was supplied by the corotron charger 402, the photosensitive member was destaticized by a destaticization aligner 403. At this time, the treatment was carried out in the time shown in Table 9 as Examples 4-1 to 4-3 and Comparative Examples 4-1 and 4-2.

TABLE 9

| | Example | | | Comparative Example | |
|---|---|---|---|---|---|
| | 4-1 | 4-2 | 4-3 | 4-1 | 4-2 |
| Negative corona discharge treatment time [min.] | 60 | 30 | 10 | 5 | 0 |
| Evaluation item | | | | | |
| $sp^2$ bonding ratio in outermost surface region | 0.30 | 0.35 | 0.47 | 0.56 | 0.65 |
| Oxygen content ratio in outermost surface region | 0.21 | 0.15 | 0.08 | 0.05 | less than 0.02 |
| Hydrogen content ratio of surface layer | 0.38 | 0.38 | 0.38 | 0.38 | 0.38 |
| Barrier property | A | A | A | A | A |
| Image resolving power | A | A | B | C | D |
| Comprehensive evaluation | A | A | B | C | D |

As the evaluation result, the effect of the present invention that the barrier property and the image resolving power were compatible with each other in all of the photosensitive members of this example was confirmed. However, it was found that the modification of the outermost surface region by the negative corona discharge in the atmosphere requires a relatively long treatment time. In the case of the surface treatment by oxidation, it was found that by setting the maximum value of the oxygen content ratio in the outermost surface region to be 0.15 or more, the $sp^2$ bonding ratio can be set to be 0.40 or less and the image resolving power is further improved.

Example 5

In Example 5, similar to Example 2, the lower blocking layer, the photoconductive layer, and the upper blocking layer were sequentially formed by using the plasma CVD apparatus of FIG. 3 under the conditions shown in the above Table 1, and the surface layer was laminated under the forming conditions of S2. In addition, the photosensitive member was manufactured by forming the outermost surface region under the forming conditions of B1. However, in Examples 5-1 and 5-2, the film thickness of the outermost surface region was set as shown in Table 10.

The average value of the "hydrogen content ratio" of the surface layer of the manufactured a-Si photosensitive member and the maximum value of the "$sp^2$ bonding ratio" of the outermost surface region of the surface layer were evaluated by the same method as Example 1. In addition, as the characteristics of the manufactured a-Si photosensitive member, the image resolving power and the barrier property were evaluated by the same method as Example 1. In addition, the residual potential was evaluated by the following specific method. The evaluation results are shown in Table 10.

(Evaluation of Residual Potential)

The evaluation of the residual potential was performed using the remodeling machine of the digital electrophotographic apparatus "image.RUNNER.ADVANCE.C7065" (trade name) manufactured by Canon Inc. The remodeling machine was configured to apply the primary charging from the external power supply.

The manufactured photosensitive member was mounted on the Bk station of the electrophotographic apparatus, and adjusted the primary current of the primary charging and the grid voltage so that the dark part surface potential of the photosensitive member was set to be −500 V. Next, in a state of being charged under the previously set charging conditions, the image exposure light was irradiated at an intensity of 0.9 $\mu J/cm^2$, and the potential at the position of the developing device was measured, and the potential at this time was set as the residual potential.

The obtained results were ranked based on the following criteria, by setting the residual potential of the photosensitive member of Example 2-1 as a reference (100%).

A: 95% or more and less than 105% compared to the reference

B: 105% or more and less than 115% compared to the reference

C: 115% or more compared to the reference

In the evaluation method, it is said that the smaller the residual potential, the more preferable the photosensitive member characteristics becomes.

TABLE 10

| | Example 2-1 | Example 5-1 | Example 5-2 |
|---|---|---|---|
| Film thickness of outermost surface region [nm] | 3 | 5 | 10 |
| Evaluation item | | | |
| $sp^2$ bonding ratio in outermost surface region | 0.32 | 0.32 | 0.32 |
| Hydrogen content ratio of surface layer | 0.49 | 0.49 | 0.49 |
| Barrier property | A | A | A |
| Image resolving power | A | A | A |
| Residual potential | A | A | B |
| Comprehensive evaluation | A | A | B |

As the evaluation result, the effect of the present invention that the barrier property and the image resolving power of the photosensitive member of this example were compatible with each other in all of the photosensitive members of this example was confirmed. It is found that the image resolving power is good even when the film thickness of the outermost surface region is small. On the other hand, from the viewpoint of the residual potential, it is said that the film thickness of the outermost surface region is more preferably in a range of 5 nm or less.

Example 6

In Example 6, similar to Example 2, the lower blocking layer, the photoconductive layer, and the upper blocking layer were sequentially formed by using the plasma CVD apparatus of FIG. 3 under the conditions shown in the above Table 1, and the surface layer was laminated under the forming conditions of S2. In addition, the photosensitive member was manufactured by performing, on the outermost surface region, the surface treatment under the treatment conditions of A6. However, in Examples 6-1 to 6-4, the film thickness of the surface layer was set as four kinds shown in Table 11.

The average value of the "hydrogen content ratio" of the surface layer of the manufactured a-Si photosensitive member and the maximum value of the "$sp^2$ bonding ratio" of the outermost surface region of the surface layer were evaluated by the same method as Example 1. In addition, as the characteristics of the manufactured a-Si photosensitive member, the image resolving power and the barrier property were evaluated by the same method as Example 1. In addition, the sensitivity characteristics were evaluated by the following specific method. The evaluation results are shown in Table 11.

(Evaluation of Sensitivity Characteristics)

The evaluation of the sensitivity characteristics of the photosensitive member was performed using the remodeling machine of the digital electrophotographic apparatus "image.RUNNER.ADVANCE.C7065" (trade name) manufactured by Canon Inc. The remodeling machine was configured to apply the primary charging from the external power supply.

The manufactured photosensitive member was mounted on a Bk station of a digital electrophotographic apparatus "image.RUNNER.ADVANCE.C7065", and adjusted a primary current of the primary charging and a grid voltage so that a dark part surface potential of the photosensitive member was set to be −500 V. Next, the image exposure light was irradiated in a state of being charged under the previously set charging conditions, and the potential at the position of the developing device was set to be −150 V at the time of the whole surface exposure by adjusting the irradiation energy.

The obtained results were ranked based on the following criteria by setting the irradiation energy as a reference (100%) when the photosensitive member of Example 6-1 is mounted.

A: 95% or more and less than 105% compared to the reference

B: 105% or more and less than 115% compared to the reference

C: 115% or more compared to the reference

In the evaluation method, it can be said that the smaller the irradiation energy, the more preferable the photosensitive member characteristics becomes.

TABLE 11

| | Example | | | | |
|---|---|---|---|---|---|
| | 6-1 | 6-2 | 3-3 | 6-3 | 6-4 |
| Film thickness of surface layer [nm] | 20 | 50 | 100 | 200 | 300 |
| Evaluation item | | | | | |
| $sp^2$ bonding ratio in outermost surface region | 0.30 | 0.30 | 0.30 | 0.30 | 0.30 |

TABLE 11-continued

| | Example | | | | |
|---|---|---|---|---|---|
| | 6-1 | 6-2 | 3-3 | 6-3 | 6-4 |
| Hydrogen content ratio of surface layer | 0.38 | 0.38 | 0.38 | 0.38 | 0.38 |
| Barrier property | A | A | A | A | A |
| Image resolving power | A | A | A | A | A |
| Sensitivity characteristics | A | A | A | A | B |
| Comprehensive evaluation | A | A | A | A | B |

As the evaluation result, from the viewpoint of the barrier property manufactured in this example, it can be said that the film thickness of the a-C:H surface layer is preferably 20 nm or more, and from the viewpoint of the sensitivity, the film thickness of the a-C:H surface layer is preferably 300 nm or less.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-168829, filed Sep. 1, 2017, which is hereby incorporated by reference herein in its entirety.

What is claimed is:

1. An electrophotographic photosensitive member including a substrate, a photoconductive layer, and a surface layer made of hydrogenated amorphous carbon in this order, wherein an average value of a hydrogen content ratio of the surface layer is 0.40 or less, and a maximum value of a $sp^2$ bonding ratio in an outermost surface region is 0.50 or less when a region having a depth of 5 nm or less from an outermost surface of the surface layer is defined as the outermost surface region.

2. The electrophotographic photosensitive member according to claim 1, wherein the maximum value of the hydrogen content ratio in the outermost surface region is 0.45 or more.

3. The electrophotographic photosensitive member according to claim 1, wherein the outermost surface region includes an oxygen atom, and a maximum value of an oxygen content ratio in the outermost surface region is 0.15 or more.

4. The electrophotographic photosensitive member according to claim 1, wherein a film thickness of the surface layer is 20 nm or more and 300 nm or less.

5. The electrophotographic photosensitive member according to claim 1, wherein the maximum value of the $sp^2$ bonding ratio in the outermost surface region is 0.40 or less.

6. The electrophotographic photosensitive member according to claim 1, wherein the photoconductive layer is a photoconductive layer made of hydrogenated amorphous silicon.

7. The electrophotographic photosensitive member according to claim 1, wherein a lower blocking layer is provided between the substrate and the photoconductive layer.

8. The electrophotographic photosensitive member according to claim 7, wherein the lower blocking layer has a nitrogen atom.

9. The electrophotographic photosensitive member according to claim 1, wherein an upper blocking layer is provided between the photoconductive layer and the surface layer.

10. An electrophotographic apparatus including an electrophotographic photosensitive member, wherein the electrophotographic photosensitive member includes a substrate, a photoconductive layer, and a surface layer made of hydrogenated amorphous carbon in this order, an average value of a hydrogen content ratio of the surface layer is 0.40 or less, and a maximum value of a $sp^2$ bonding ratio in an outermost surface region is 0.50 or less when a region having a depth of 5 nm or less from an outermost surface of the surface layer is defined as the outermost surface region.

* * * * *